US005111757A

United States Patent [19]

Reindl et al.

[11] Patent Number: 5,111,757

[45] Date of Patent: May 12, 1992

[54] DYNAMIC CONTAINMENT VESSEL

[75] Inventors: Wilhelm J. Reindl, St. Paul; Kenneth J. Reid, Edina, both of Minn.

[73] Assignee: Regents of the University of Minnesota, St. Paul, Minn.

[21] Appl. No.: 704,679

[22] Filed: May 21, 1991

[51] Int. Cl.[5] ..... F23D 1/02

[52] U.S. Cl. ..... 110/264; 431/173

[58] Field of Search ..... 110/264, 346; 431/9, 431/173

[56] References Cited

U.S. PATENT DOCUMENTS

| | | | |
|---|---|---|---|
| 3,777,678 | 12/1973 | Lutes et al. | 110/8 |
| 4,120,640 | 10/1978 | Martin | 431/173 X |
| 4,507,075 | 3/1985 | Buss et al. | 431/173 X |
| 4,569,295 | 2/1986 | Skoog | 110/264 X |
| 4,584,948 | 4/1986 | Syred et al. | 110/264 |
| 4,715,301 | 12/1987 | Bianca et al. | 110/264 X |

*Primary Examiner*—Edward G. Favors

*Attorney, Agent, or Firm*—Kinney & Lange

[57] ABSTRACT

A dynamic containment vessel defined by a stable fluid recirculation within a generally cylindrical containment region. The dynamic vessel is maintained by fluid momentum which establish superposed line and ring vortices within the containment region. Particles entrained within the containment vessel are retained until reduced to a preselected particle size and discharged along the axis of the vessel. Fluid injection nozzles are positioned at least at the discharge end of the vessel, at the perimeter of the containment region, and are oriented to inject gas into the containment region with a momentum having a component tangential to the cylindrical containment region and a component parallel to the longitudinal axis of the cylindrical containment region. The entrained particles may be a fuel, in which case the containment vessel may serve as a combustor.

29 Claims, 2 Drawing Sheets 36
30

11
20
21
10
35
13
33
31
26
25
28
32

12

DYNAMIC CONTAINMENT VESSEL

This is a continuation of application Ser. No. 07/432,317 filed on Nov. 3, 1989, abandoned as of the date of this application which is a continuation of application Ser. No. 07/246,085 filed on Sept. 19, 1988, both of which are now abandoned.

BACKGROUND OF THE INVENTION

1. Field of the Invention

The present invention relates to dynamic containment vessels and, in particular, to the maintenance of a stable vortical motion which defines such vessel. In a preferred embodiment, the present invention may be employed as a combustor.

2. Description of the Prior Art

Magnetic bottles for the confinement of charged particles are well known. The present invention provides an analogue to a magnetic bottle for the containment of a fluid flow and any entrained particles. The present invention has particular application to combustors and will be described with reference thereto.

Vortical flows within combustors are known to the prior art. Typically, such combustors establish a swirling movement within a combustion chamber as by a tangential injection of fuel and entraining gas into the chamber. This swirling motion is often augmented by the tangential injection of gas into the combustion chamber at various locations along the length of the combustion chamber. Such combustors are generally referred to as cyclone combustors, an example of which is shown in U.S. Pat. No. 3,777,678, issued Dec. 11, 1973, for CYCLONIC TYPE FUEL BURNER.

Among the advantages of the prior art cyclonic type combustors, are relatively long residence times. The nature of the flow into and through the combustion chamber provides significant wall interaction, often resulting in vortical flow. However, these wall interactions produce a high degree of abrasion and/or wall heating as well as corrosion, all of which heavily burdens the wall material.

SUMMARY OF THE INVENTION

The present invention provides a dynamic containment vessel defined by a stable fluid recirculation within a generally cylindrical containment region. The dynamic vessel is maintained by fluid momentum through the establishment of superposed line and ring vortices within the containment region. Line vortices are basically vortices created by potential flow fields. The necessary circulation is generated through boundary effects or the interaction of impulse vectors from individual fluid jets through the particular arrangement of individual jet nozzles. Commonly recognized examples of line vortices are tornados or hurricanes. Gases and material particles are drawn into this dynamic structure predominantly at the "bottom" and ejected at the "top." Ring vortices, on the other hand, are commonly best known from smoke rings. These structures seem to be even more stable. Once generated they will decay very slowly—mainly through frictional losses with the surrounding environment—and can rise to great heights without decay.

Line and ring vortices can be represented mathematically through their vorticity vectors as vector fields which are perpendicular to each other. Each line vortex is represented by a vorticity vector pointing in the direction of the vortex axis and each ring vortex can be viewed as composed of an infininte number of infinitesimally short line vortices whose centers are located on a ring. Therefore their respective vectors form a vector field in the form of a ring.

In order to superimpose these two vortex structures to form a new structure, these two types of vorticity vectors and vector fields have to be orthogonal and therefore, due to vector algebra, independent. The resulting dynamic structure has unique capabilities in capturing and retaining fluids and particles within a dynamically defined region. The boundary of this region in general will not coincide with the vessel walls and theoretically it is possible to move the walls to infinity and the dynamic structure becomes self-contained. These two independent types of vortices can be generated in a variety of ways including jet interaction from appropriate fluid nozzles, jet boundary interaction, or viscous effects.

In a preferred embodiment, the present invention provides a combustor in which a vortical flow is established without significant wall interaction. In this manner, the material of the combustion chamber wall is less critical than in prior art cyclonic type combustors. Indeed, the present invention allows a containment of the combustion to a combustion region without wall interaction such that the combustion chamber can be dispensed with, if desired. Any particles, such as fuel or other constituents to be acted upon, are introduced into the containment region and entrained in the gas flow for circulation therewith within the containment region.

In the disclosed embodiment, the superposed vortices are established by recirculation with gas injection nozzles being positioned at one end of the containment vessel and oriented to inject gas into the containment region with a momentum having a tangential component as well as a component parallel to the longitudinal axis of the containment region. Discharge from the containment vessel is along the longitudinal axis of the containment region, at the one end thereof. The nozzles described above are positioned at the perimeter of the containment vessel. The inlet (other end) end of the containment vessel is spaced from the discharge end along the longitudinal axis of the cylindrical containment region. Recirculation at the inlet end of the containment vessel may be established by injection nozzles having a tangential component only or, alternatively, through the use of a physical wall and/or an axial gas blower whose discharge has a rotation corresponding to the tangential component of the gas injected at the discharge end of the containment region.

There is no "skin effect" in a containment vessel in accordance with the present invention. Particles introduced into the containment region are drawn into the fluid flow and entrained within that fluid flow. Thus, fuels introduced into the containment region, and ignited therein, will remain in the containment region until they are reduced to a preselected size. Particles introduced into the fluid flow will be drawn into the gas flow to act on each other, as by grinding, again until they are reduced to a preselected size. The size of the containment vessel and other operating parameters, such as pressure, flow rates, etc., may be acted upon to optimize them for the particular application.

DETAILED DESCRIPTION OF THE PREFERRED EMBODIMENTS

The present invention provides a dynamic containment vessel defined by a stable fluid recirculation within a generally cylindrical containment region. The dynamic vessel is maintained by fluid momentum resulting from the superposition of at least two vortices—a ring vortex and a line vortex. The terms "ring vortex" and "line vortex" are described above and will be further understood from the discussion below.

Figures 1, 1A:
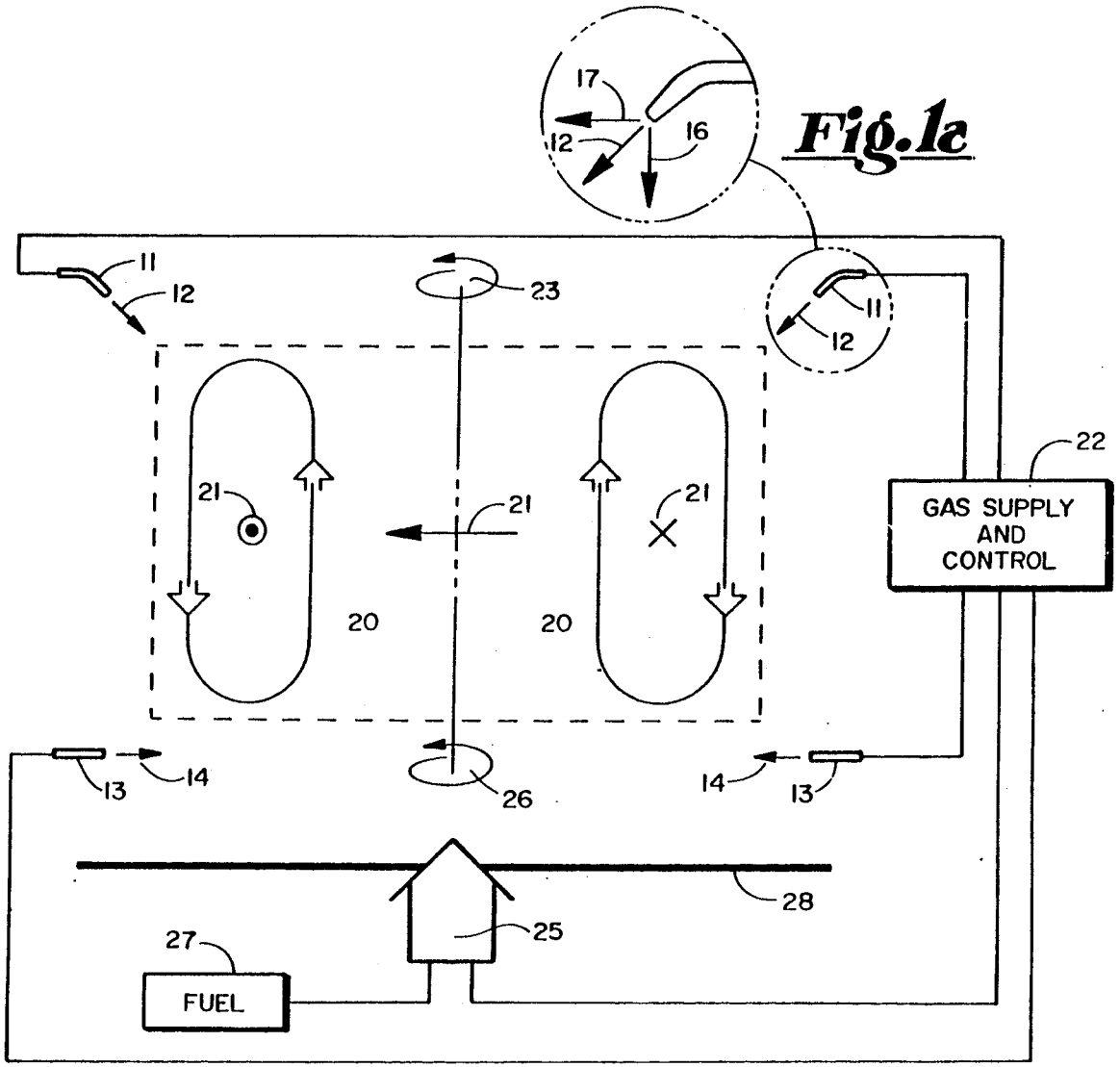
FIG. 1 and 1*a* illustrate the concept of the present invention and, diagrammatically, apparatus by which the present invention may be practiced.

Referring now to FIG. 1, the concept of the present invention is illustrated as is apparatus by which the present invention may be practiced. The dashed rectangle 10 is a containment region within which the superposed vortices of the present invention are established. In the embodiment illustrated in FIG. 1, the vortices are established by gas injection nozzles 11, whose discharges are illustrated by the arrows 12, and gas injection nozzles 13 whose discharges are illustrated by the arrows 14. The containment region 10 is generally cylindrical having a longitudinal axis 15.

Each of the nozzles 11 and 13 are positioned at the perimeter of the containment region 10 with the nozzles 11 being and oriented to inject gas into the containment region 10 with a momentum having a component tangential to the containment region and a component parallel to the longitudinal axis 15 of the containment region. This is illustrated in the enlarged view of FIG. 1 wherein one of the nozzles 11 and its discharge 12 are illustrated, with the arrow 16 representing the "longitudinal" component of the discharge 14 and the arrow 17 representing the "tangential" component of the discharge 14 of the nozzle 11. The nozzles 13 have a tangential component only.

The flow pattern established by the combined effects of the nozzles 11 and 13 may be viewed as a stable recirculation flow within the generally cylindrical containment region 10 and as being formed by superposed line and ring vortices within the containment region 10. The ring vortices are illustrated by the closed flow paths 20 whose arrows indicate the direction of circulation. Essentially, these ring vortices are formed by the components of the discharge of the nozzles 11 parallel to the longitudinal axis 15 of the containment region 10 (See arrow 16) and the "wall" formed by the discharge of the nozzles 13. Similarly, a second vortex—a "line" vortex whose direction is indicated by the arrows 21—is formed by the tangential component of the discharge of the nozzles 11 (See arrow 17) and the tangential discharge of nozzles 13.

Figures 2, 3, 3A:
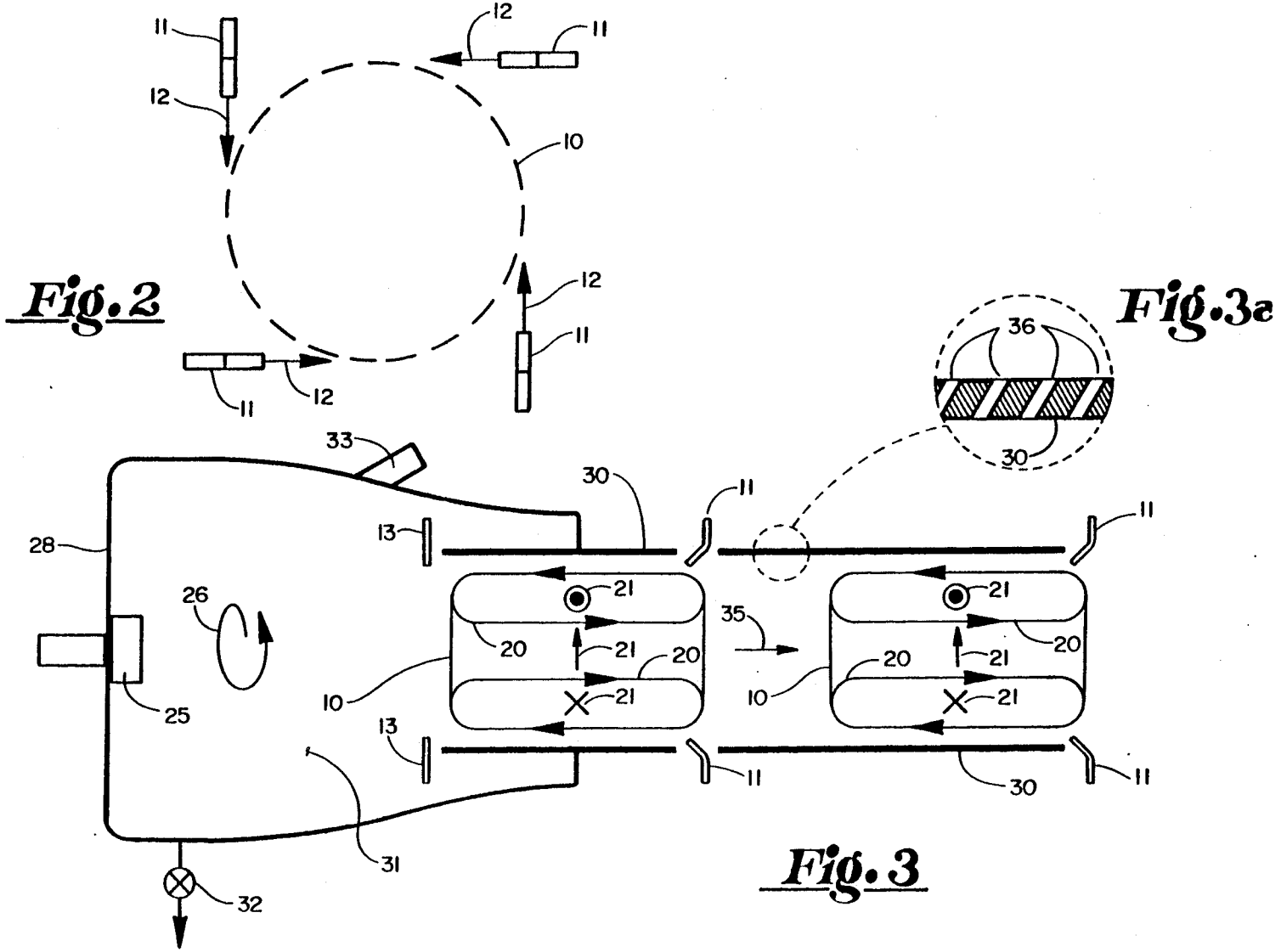
FIG. 2 is a top view of an embodiment of the present invention corresponding to that illustrated in FIG. 1.
FIGS. 3 and 3*a* illustrate a particular configuration by which the present invention may be practiced and also illustrates the staging of multiple containment vessels in accordance with the present invention.

FIG. 2 further illustrates the tangential component of the nozzles 11 and their relation to the containment region 10. In FIG. 2, four nozzles 11 are shown positioned at the periphery of the containment region 10. The number of nozzles, and their position around the periphery of the containment region 10, is variable depending on the application and the conditions within the containment region 10 it is desired to maintain. The "angle" of the nozzles 11, by which their relative components 16 and 17 are determined, are dependent upon the relative sizes of the ring and line vortices and the particular application and are within the skill of one ordinarily skilled in the art.

The discharges 12 and 14 from the nozzles 11 and 13, respectively, are established and controlled by a GAS SUPPLY AND CONTROL 22, the control 22 serving to establish the size of the containment region 10 by establishing the relative dimensions of the vortices 20 and 21 for a given "angle" of the nozzles 11. It is within the scope of the present invention to superpose additional vortices on the ring vortex 20 and line vortex 21 within the constraint that the resulting flow pattern be a stable gas recirculation flow pattern confined to a containment region such as the cylindrical region 10 illustrated in FIGS. 1 and 2.

The combined effects of the nozzles 11 and 13 illustrated in FIGS. 1 and 2, will establish a stable gas recirculation within the containment region 10 thereby defining a containment vessel. Gas will be discharged in a rotating flow pattern about the longitudinal axis 15 and will have a general direction parallel to the axis 15 as shown by the arrow 22, given the flow pattern of the vortices 20 and 21 in the illustration of FIG. 1.

The nozzles 11 and 13 described above can, under the control of GAS SUPPLY AND CONTROL 22, establish a "free-standing" dynamic containment vessel having the characteristics described above. By free-standing it is meant that the vessel is independent of any surrounding housing or chamber in a manner analagous to a magnetic bottle for charged particles. Such a vessel, and any vessel established and maintained in accordance with the present invention, may be employed for various processing operations—as a "grinder" or as a "polisher" or as a combustor, for example. Indeed, any application requiring the containment of a fluid with or without entrained particles, may be accomplished in accordance with the present invention. In a grinding operation, the particles to be ground are introduced into the containment region 10 where they are drawn into the recirculating flow pattern. There is no "skin effect," thus rendering the introduction of particles relatively easy. The particles are retained within the flow pattern (i.e. they remain entrained) until such time as the flow is overloaded at which time the smaller particles (those reduced sufficiently to allow them to "escape") are drawn into the exhaust and from the vessel along the direction of the arrow 22. Combustion works in a similar manner. That is, fuel may be introduced as particles or a gas to be drawn into the flow and retained within the flow until combustion is sufficiently complete such that reduced particles are discharged. Proper regulation of the control 22 will allow fuel to remain within the flow until combustion is essentially complete. Particles may be introduced in any desirable way, an example of which is discussed more fully below. Gases may be introduced via the nozzles while liquids to be entrained may be introduced after first being gasified. Of course, a liquid vessel may be established in which case the liquid is introduced via nozzles.

The bold arrow 25 in FIG. 1 represents a blower in general alignment with the axis 15 of the containment region 10. Preferably, the blower, which may be supplied by the supply 22, has a swirling or rotational aspect to its output as represented by the arrow 26, the direction of rotation of the output of the blower 25 corresponding to the rotational direction of the line vortex 21. Fuel (or any other particulate material) may be entrained within the output of the blower 25 to be carried within the containment region 10 as represented by the box 27 in FIG. 1. An alternative to fuel/particulate introduction is discussed below with reference to FIG. 3.

Still referring to FIG. 1, the blower 25 allows an elimination of the nozzles 13, assuming its output is sufficient to establish the flow dynamics contributed to by the nozzles 13. Thus, with sufficient output from the blower 25, the combination of its flow characteristics with those induced and maintained by the nozzles 11 will establish the superposed ring and line vortices 20 and 21, respectively, as illustrated in FIG. 1. In a preferred embodiment, the blower 25 is positioned within a backwall 28, the back pressure established by the wall 28 serving to establish and maintain the ring vortices 20 in a manner which will be apparent to those skilled in the art. In operation, it is desirable that the containment region 10 be spaced from the wall 28 to minimize impingement on the wall 28 of any particles entrained within the containment vessel and to isolate the wall 28 from the heat of any combustion within the vessel. Suitable adjustment of the flow through the nozzles 11 as well as the nozzles 13 and blower 25, when employed, allows a movement of the containment region (and the containment vessel located therein) relative to the wall 28 as well as providing a modification in the configuration of the ring vortex 20 and the line vortex 21 relative to each other. These adjustments are dependent upon the application and are within the skill of one of ordinary skill in the art having access to the teachings of this specification.

FIG. 3 illustrates a preferred embodiment of the present invention in a multiple stage application as well as modifications thereto. In the embodiment of FIG. 3, a vortex tube 30 is provided within which the containment region 10 (see FIG. 1) is at least partially located and which serves as a shield as well as a supporting structure for the nozzles 11 and 13. An entrainment chamber 31 is formed around one end (the inlet end) of the vortex tube 30, the entrainment chamber 31 having a rear wall 28 corresponding to that of FIG. 1. A blower 25 is provided within the wall 28 while a valve 32 is provided for the removal of slag and other material that gathers within the entrainment chamber 31. Fuel for combustion (or particulate material for grinding, for example) may be introduced into the entrainment chamber via an inlet 33. In FIG. 3, the elements of like reference numeral correspond directly to those of the embodiment of FIGS. 1 and 2.

In operation, the embodiment of FIG. 3 has a flow established through the nozzles 11 which, in conjunction with the backwall 28, establishes a containment vessel at least partially within the tube 30 and which typically extends from the vortex tube 30 toward and nearly to the wall 28. Air flow from the blower 25 may be employed to cause the containment region (and the containment vessel within it) to move from the entrainment chamber to be more fully positioned within the vortex tube. The nozzles 13 may be employed to confine the containment region to the vortex tube, at least on one end thereof. Again, the position of the containment region and vessel relative to the vortex tube is established by the flow characteristics through the nozzles 11 and 13 as well as the blower 25. With the containment region/containment vessel located within the vortex tube 30, particulate material may be introduced via the inlet tube 33 to the entrainment chamber 31. Discharge from the blower 25 will entrain the particulate material and carry it into the vortex tube wherein it will be drawn into the flow established by the superposed vortices defining the containment vessel. Entrained particulate material will interact within the containment vessel until it is reduced. When the containment vessel is sufficiently "loaded" by the addition of particulate material, the smaller particles (the size being dependent on flow characteristics and loading) will be expelled or discharged as indicated at the arrow 35. This discharge may be employed in a manner amalagous to the output of the blower 25 for a second stage formed of a vortex tube 30 and nozzles 11 at the discharge of the second (rightmost in FIG. 3) vortex tube 30. Thus, a second stage containment vessel is provided which will accept any particles within the discharge from the first containment vessel and further reduce them, if desired. Such staging may be particularly useful for the "burning" of toxic wastes to totally eliminate them by combustion. Other applications will be immediately be apparent to those familiar with the art. FIG. 3 also illustrates, in an enlarged view, a further modification in the form of gas injectors that form the vortex tube 30. These injectors 36 may be angled in a manner corresponding to the nozzles 11 to augment the flow patterns established by the nozzles 11 as well as to provide a cushion of gas between the containment region/containment vessel and the vortex tube 30.

Obviously, many modifications and variations of the present invention are possible in light of the above teachings. For example, injectors 36 may be employed, as desired. While the nozzles 11 are believed necessary in all applications, one or more of the nozzles 13, backwall 28 and blower 25 may be emlpoyed to maintain the superposed vortices described herein. Particle processing may take any desired form and multiple stages may be employed, dependent upon the desired final characteristics of the discharge. It is therefore to be understood that, within the scope of the appended claims, the invention may be practiced otherwise than as specifically described.

What is claimed is:

1. A dynamic containment vessel defined by stable fluid recirculation within a generally cylindrical containment region, the dynamic vessel being maintained by fluid momentum, and including first and second means spaced from each other along the direction of the longitudinal axis of the cylindrical containment region for establishing superposed line and ring vortices within the containment region, the dynamic containment vessel having means for injecting material in a vortical pattern in general alignment with the longitudinal axis, and wherein at least one of said first and second means is active.

2. The dynamic containment vessel of claim 1 wherein the active ones of said first and second means comprise fluid injection means.

3. The dynamic containment vessel of claim 2 wherein the fluid injection means comprise nozzles positioned at the perimeter of said containment region and oriented to inject gas into the containment region with a momentum having a component tangential to the cylindrical containment region and a component parallel to the longitudinal axis of the cylindrical containment region.

4. The dynamic containment vessel of claim 3 wherein each of said first and second means are active.

5. The dynamic containment vessel of claim 1 wherein each of said first and second means comprise fluid injection means.

6. The dynamic containment vessel of claim 5 wherein the fluid injection means comprise nozzles positioned at the perimeter of said containment region and oriented to inject fluid into the containment region with a momentum having a component tangential to the cylindrical containment region, the first means fluid injection means nozzles also having a component parallel to the longitudinal axis of the cylindrical containment region.

7. The dynamic containment vessel of claim 1 wherein the first means comprise gas injection nozzles positioned at the perimeter of the cylindrical containment region at one end thereof, said gas injection nozzles being oriented to inject gas into the containment region with a momentum having a component tangential to the cylindrical containment region and a component parallel to the longitudinal axis of the cylindrical containment region.

8. The dynamic containment vessel of claim 7 wherein said second means comprises a wall positioned at the other end of said containment region.

9. The dynamic containment vessel of claim 8 further comprising blower means for injecting gas into the containment region along said longitudinal axis and from said other end, the discharge of said blower means having a rotation corresponding to the tangential component of gas injected at said one end.

10. The dynamic containment vessel of claim 7 wherein said second means comprises blower means for injecting gas into the containment region along said longitudinal axis, the discharge of said blower means having a rotation corresponding to the tangential component of gas injected at said one end.

11. The dynamic containment vessel of claim 10 wherein said blower means comprises an adjacent dynamic containment vessel in accordance herewith.

12. A double vortex combustor wherein a stable gas recirculation is maintained within a combustion region by gas momentum wherein the combustion region has a longitudinal axis and the combustor includes means for establishing superposed line and ring vortices within the combustion region, and for introducing fuel in a vortical pattern in general alignment with the longitudinal axis of the combustion region.

13. The double vortex combustor of claim 12 wherein the combustion region is generally cylindrical, the means for establishing superposed vortices comprising gas injecting means oriented to inject gas into the combustion region with a momentum having a component tangential to the cylindrical combustion region and a component parallel to the longitudinal axis of the cylindrical combustion region.

14. The double vortex combustor of claim 13 further comprising a vortex tube defining at least a portion of said combustion region, the vortex tube having an exhaust end and an inlet end and the fuel introducing means comprising a fuel entraining chamber positioned at the inlet end of the vortex tube.

15. The double vortex combustor of claim 14 wherein the gas injecting means further comprise gas injectors positioned along the vortex tube.

16. The double vortex combustor of claim 15 further comprising means for controlling the flow of gas through the gas injecting means.

17. The double vortex combustor of claim 13 further comprising means for controlling the flow of gas through the gas injecting means.

18. The double vortex combustor of claim 12 further comprising means for establishing superposed vortices in a second region, said second region accepting gases exhausted from said combustion region.

19. The double vortex combustor of claim 13 wherein the gas injecting means comprise nozzle means positioned at the perimeter of said combustion region.

20. The double vortex combustor of claim 14 wherein the gas injecting means comprise nozzle means positioned at the exit end of said vortex tube.

21. Apparatus for burning combustible material comprising:

a vortex tube having an inlet, an exit and a longitudinal axis;

an entraining chamber positioned at the vortex tube inlet;

means for introducing combustible material in a vortical pattern in general alignment with the longitudinal axis and for entraining gas into the entraining chamber; and means for establishing superposed line and ring vortices at least partially within said vortex tube to create a dynamic combustion zone.

22. The apparatus of claim 21 wherein the vortex tube is generally cylindrical, the means for establishing superposed vortices comprising nozzles oriented to inject gas into the vortex tube with a momentum having a component tangential to the cylindrical vortex tube and a component parallel to the longitudinal axis of the cylindrical vortex tube.

23. The apparatus of claim 22 wherein the gas injector means further comprise means for injecting gas at spaced locations along the vortex tube.

24. The apparatus of claim 22 further comprising:

a second tube having an inlet and an exit, the second tube inlet being positioned to accept gases from said vortex tube exit; and gas injector means injecting gas into said second tube for establishing stable superposed vortices at least partially within said second tube.

25. The double vortex combustor of claim 24 further comprising means for controlling the flow of gas through the gas injecting means.

26. An apparatus for establishing a dynamic containment zone and for controlling vortical flow in the dynamic containment zone, the dynamic containment zone having a longitudinal axis and an end zone, and being suitable for containing particles, the apparatus comprising:

superposing means for superposing momentum by creating a plurality of superposed vortices around the longitudinal axis of the dynamic containment zone; and means for providing material in a vortical pattern in general alignment with the longitudinal axis of the dynamic containment zone, the superposed vortices and the material provided in a vortical pattern cooperating to form a substantially fluid dynamically stable recirculation zone.

27. The apparatus of claim 26 wherein the means for providing vorticity comprises:

means for creating a fluid wall in the end zone of the dynamic containment zone to establish recirculation within the dynamic containment zone.

28. The apparatus of claim 26 wherein the superposed vortices and the material provided in a vortical pattern are substantially balanced to maintain the particles entrained in an orbit around the longitudinal axis of the dynamic containment zone.

29. A dynamic containment vessel having stable fluid recirculation within a generally cylindrical containment region, comprising:

two generally concentric rotating fluid cylinders;

first and second means, spaced along a longitudinal axis of the generally concentric fluid cylinders for establishing rotation of the fluid cylinders, at least one of the first and second means providing material in a vortical pattern in general alignment with the longitudinal axis of the rotating cylinders, and at least one of the first and second means creating suction to entrain particles into the cylindrical containment region.

* * * * *